United States Patent [19]

Ovchinnikov et al.

[11] 3,948,409

[45] Apr. 6, 1976

[54] CRYOSTAT

[76] Inventors: Viktor Sergeevich Ovchinnikov, Yaroslavskoe shosse, 28, kv. 16; Eduard Ivanovich Grigorov, Prospekt Mira, 90, kv. 78; Arkady Lukyanovich Magdesian, ulitsa Zheleznodorozhnaya, 3, kv. 4; Andrei Vasilievich Bermishev, ulitsa Grishina, 8, kv. 44; Vladimir Ivanovich Gorelikov, Serpukhovsky val, 19/43, kv. 184; Alexandr Stepanovich Utkin, ulitsa Stroitelei, 10, kv. 285; Viktor Konstantinovich Fedotov, ulitsa Khalturina, 14, korpus 2, kv. 34; Vladimir Yakovlevich Volkov, Arbatskaya ploschad, 6, kv. 39, all of, Moscow, U.S.S.R.

[22] Filed: Nov. 12, 1974

[21] Appl. No.: 523,236

[52] U.S. Cl. ..... 220/9 C; 62/514 R; 220/9 LG

[51] Int. Cl.[2] ..... B65D 25/18

[58] Field of Search..... 62/45, 514, DIG. 13; 220/9 LG, 9 C, 15, 85 P, 89 A; 137/68 R

[56] References Cited

UNITED STATES PATENTS

| | | | |
|---|---|---|---|
| 646,459 | 4/1900 | Place | 220/9 LC |
| 3,059,804 | 10/1962 | Wissmiller | 62/45 X |
| 3,114,469 | 12/1963 | Francis et al. | 62/45 X |

*Primary Examiner*—Carroll B. Dority, Jr.
*Assistant Examiner*—Ronald C. Capossela
*Attorney, Agent, or Firm*—Robert E. Burns; Emmanuel J. Lobato; Bruce L. Adams

[57] ABSTRACT

A vacuum-tight coat of the cryostat encloses a thermally insulated vessel, intended to keep cryogenic products, so that between the surfaces of said elements there is a heat-insulating cavity from which air is evacuated. In order to build up vacuum in the cavity a vacuum valve on the vacuum-tight coat is provided. Between the inlet opening of the vacuum valve and the thermally insulated vessel, there is disposed a cup which is fixed rigidly in the heat insulating cavity. The cup has perforations evenly distributed on its lateral surfaces.

The heat-insulating cavity of the proposed cryostat, having the capacity of 47 liters, should be evacuated for 7 days at the capacity of the evacuating system of 200 liters (at STP) per hour. In other words, owing to the special design of the vacuum valve, the evacuation of the heat-insulating cavity of the cryostat is effected in accordance with the capacity of the evacuation system, and the vacuum-multilayer insulation remains intact during this process.

5 Claims, 2 Drawing Figures

CRYOSTAT

BACKGROUND OF THE INVENTION

This invention relates generally to cryogenic technology, and more particularly it relates to cryostats intended for storing biological materials at very low temperatures.

The invention can be used in animal breeding for lengthy storing biological materials, mainly semen of pedigree cattle at cryogenic temperatures, for example, at the temperature of liquid nitrogen; it can also be used in medicine for storing biological preparation such as live tissues, blood, etc, at cryogenic temperatures.

There are known at the present time cryostats comprising a metallic vessel for cryogenic products, inside which various devices for storing biogenic materials can be placed. The vessel is held in a vacuum-tight membrane by its neck and fixed in the required position by stretching in the lower part. The vessel is so placed in the vacuum-tight membrane such that a cavity is formed between them in which heat insulating material is placed. A vacuum valve is installed on the surface of the vacuum-tight membrane to ensure a vacuum in the air-tight insulating cavity.

The vacuum valve is a pipe-branch, one end of which, ending in a filter in the form of a perforated disc, is fixed on the inner surface of the vacuum-tight membrane, while its other end is intended to communicate with the vacuum system during evacuation of the air-tight cavity of the cryostat. As soon as the cavity is fully evacuated, and the vacuum system is disconnected, the pipe-branch is clamped and soldered to ensure tightness of the evacuated cavity of the cryostat.

The vacuum-valve filter ensures a reliable and effective vacuum in the cryostat cavity filled with the powder-type insulation. The insulation material may be on the basis of aerogel of silicic acid, silica gel, silicon, bronze powder, or mixtures of aerogel, silicon and other materials with metallic powders of copper, brass, bronze. The heat conduction coefficient of such vacuum-powder insulation is $0.5\times10^{-3} - 4\times10^{-3}$ kcal/m × hour × degree; the density of such powders is 100 – 1900 kg/cu.m., the average particle size is from 0.005 to 0.25 mm.

Heat insulation can also be made out of fibre material, for example, on the basis of glass fibre of mineral fibre obtained from melts. The fibres are held together by the natural friction forces, with bakelite varnish, toluene solution of silicon-organic resin, or other binders. Vacuum-fibre insulation has the effective coefficient of heat conduction of about $0.5\times10^{-3} - 4.5\times10^{-3}$ kcal/m × hour × degree (at $P = 1\times10^{-3}$ mm Hg), the density of 150–240 kg/cu.m., the fibre diameter 5–20 micron.

The filter is intended to prevent clogging of the valve, during evacuation of the cavity, with powders and fibres of the insulation used.

However, during evacuation of the insulating cavity, filled with powder insulation, its particles are set in constant motion and can therefore come in contact with the filter to decrease the section of the valve.

Fibres of the vacuum-insulation can also diminish the section of the valve, thus increasing the time of the evacuation process.

At the present time vacuum-multilayer insulation is widely used and is made out of several radiation screens, 0.005–0.02 mm thick, for example, metallic foil or metallized polyethylene terephthalate or polyamide films having high reflecting power (blackness 0.03–0.06), and linings of material having low heat conduction (heat conduction coefficient of 0.01 – 0.04 kcal/m × hour × degree). However, making use of vacuum-multilayer heat insulation with an (effective heat conduction coefficient of $4\times10^{-5} - 8\times10^{-5}$ kcal/m × hour × degree) in the known cryostats having the above construction of the vacuum valves, does not ensure reliable and effective evacuation, since vacuum-multilayer heat insulation, during operation of the vacuum system, also closes part of the filter area by clogging its perforations, owing to which the time of evacuation increases. Thus, the production capacity of the vacuum system does not correspond to evacuation of the heat-insulating cavity of the cryostat, due to which the consumption of electric energy by the vacuum system increases. Constructions are possible where the vacuum-multilayer insulation completely blocks the filter and the evacuation of the system becomes impossible.

Moreover, the known design of the vacuum valve does not ensure intactness of the vacuum-multilayer insulation when gas abruptly rushes into the cavity from the environment.

The known vacuum valve provided with a perforated disc does not reduce the flow-rate of the gas jet, and at certain flow-rates layers of heat insulation can be destroyed.

SUMMARY OF THE INVENTION

The object of this invention is to eliminate these disadvantages.

The specific object of this invention is to provide a cryostat the heat insulating cavity of which can be evacuated in agreement with the capacity of the vacuum system and the cross-section of the vacuum valve.

Another object of the invention is to provide a cryostat in which, during evacuation of the heat insulating cavity, the vacuum-multilayer insulation is not destroyed.

These objects have been accomplished in that in a cryostat comprising a thermally insulated vessel for cryogenic products, enclosed in an evacuated coat provided with a vacuum valve, according to the present invention, between the inlet opening of the valve and the thermally insulated vessel, there is a rigidly fixed a cup communicating with said valve and reaching with its bottom the outer surface of the thermally insulated vessel, the cup has perforations evenly distributed on the lateral surface.

Due to the presence of the valve, it has become possible to evacuate the heat-insulating cavity of the cryostat in agreement with the capacity of the vacuum system, the possibility of damaging the vacuum-multilayer insulation being ruled out. The time required to evacuate the heat-insulating cavity of the cryostat, having the capacity of 47 liters, to the residual pressure of $5\times10^{-5}$–$1\times10^{-4}$ mm Hg, which is required to ensure effective vacuum-multilayer insulation, is 7 days, the total value of gas evolution of the insulating material and gas ingress into the heat-insulating cavity being $1\times10^{-2}$ mc Hg lit/sec In conditions without the valve, this operation requires 12–15 days (vacuum-multilayer insulation on the basis of polyethyleneterephthalate films aluminized on both sides, and backed with glass veil, the thickness of the insulation being 45 mm, the density of packing 15 screens/cm, the diameter of the pass-through section of the vacuum valve being 20 mm, and the capacity of the vacuum unit of 200 liters (at STP) per hour).

It is recommended, according to the invention, that the bottom of the cup has the configuration corresponding to that of the outer surface of the thermally insulated vessel.

This design of the cup ensures the contact of the cup with the heat insulation along the entire surface of the cup bottom and hence the maximum area along which the vacuum gap is ensured. It is known that the effectiveness of evacuation depends directly on the size of the vacuum gap.

BRIEF DESCRIPTION OF THE DRAWINGS

Further objects and advantages of the invention will hereinafter become clear from the following detailed description and the appended drawings in which.

DESCRIPTION OF THE PREFERRED EMBODIMENTS

Figure 1:
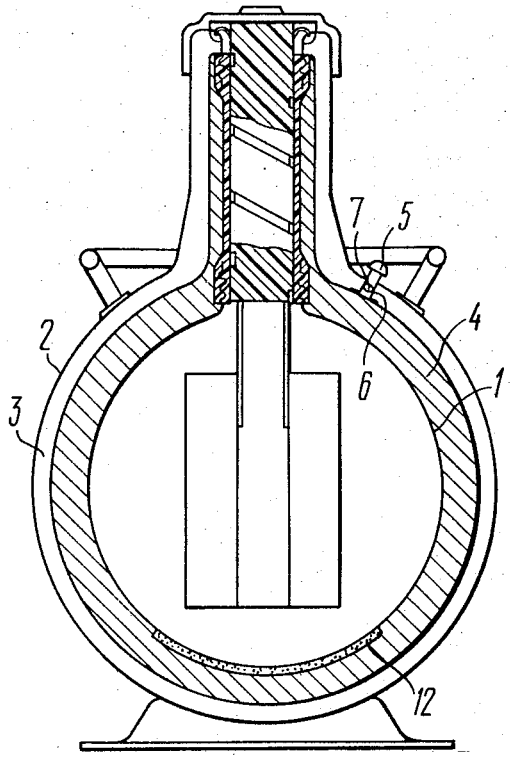
FIG. 1 is a side elevation view, in section, of a cryostat according to the invention.

The proposed cryostat comprises a thermally insulated vessel 1 (FIG. 1), provided with a neck, intended to keep cryogenic products such as liguid nitrogen, liquefied air, liquid oxygen, i.e., the products having cryogenic temperatures of the order of 80°–90° K. It is recommendable to manufacture the vessel out of aluminium alloys or other alloys having the specific gravity of 2.63 – 2.7, the tensile strength of 19–32 kg/sq.mm. The vessel 1 is placed inside a vacuum-tight jacket or coat 2 (FIG. 1) made of materials meeting the same requirements as the materials used for the manufacture of the vessel 1. The vessel 1 is enclosed in the vacuum-tight coat so that a cavity 3 (FIG. 1) is formed between them filled with heat insulating material 4 (FIG. 1), for example, vacuum-multilayer heat insulation having thickness of 45 mm at the density of packing of 15 screens per cm. The vacuum-multilayer insulation can be made of goffered polyethylene terephthalate film aluminized on both sides and backed with glass fabric.

The vacuum-tight coat 2 is provided with a vacuum valve 5 (FIGS. 1 and 2) intended to build up vacuum of $1\times10^{-4}$ mm Hg (and over) in the cavity which is necessary to ensure effective protection of the cryogenic products from the ingress of heat from the environment.

According to this invention we propose that between the inlet opening (diameter, e.g., 20 mm) of the vacuum valve 5 and the thermally insulated vessel 1, a cup 6 (FIGS. 1 and 2) should be rigidly fixed. This cup 6 prevents closing of the inlet opening of the vacuum valve 5 with layers of heat insulation during evacuation of the heat insulating cavity 3.

Moreover, this cup 6, ensures constant gap between the surface of the heat insulation 4 and the inlet opening of the vacuum valve 5.

The cup 6 is installed so that it communicates with the vacuum valve 5, and its bottom reaches the outer surface of the thermally insulated vessel 1.

We propose that the cup 6 should be made of material having the specific gravity of 2.63 – 2.7, for example of aluminium alloys — aluminium-magnesium aluminium-manganese, aluminium-copper.

The lateral surfaces of the cup 6 have evenly distributed perforations 7 (FIGS. 1 and 2) owing to which the gas flow, that abruptly rushes into the heat-insulating cavity during its repeated evacuation, and also during evacuation following the vacuum seal failure in the pipe-system, does not destroy the heat insulation, since the abruptly rushing gas-flow is distributed in currents parallel to the layers of the heat insulation, not at right angle, as is the case with the cryostats known in the prior art.

The height of the cup 6 is selected so that it touches with its bottom on the outer surface of the thermally insulated vessel without exerting any pressure on it, since otherwise compacted layers will fail to ensure adequate heat insulation. In other words, the height of the cup is equal to the size of the vacuum gap between the thermally insulated vessel 1 and the inner surface of the vacuum-tight coat 2. In order to preclude additional hydraulic resistance during the evacuation of the system, the inner diameter of the cup 6 should correspond to the diameter of the inlet opening of the vacuum valve 5, and the total area of perforations 7 located on the lateral surface of the cup 6 should not be less than the area of the pass-through section of the vessel valve 5.

In order to provide for the maximum area where the vacuum gap (the magnitude of which determines the effectiveness of evacuation) is ensured, we propose that the configuration of the cup 6 bottom should agree with the configuration of the outer surface of the thermally insulated vessel 1.

As has already been said, the vacuum gap in the gap that is formed between the outer surface of the thermally insulated vessel 1 and that part of the inner surface of the vacuum-tight coat 2, where the vacuum valve 5 is installed. The vacuum valve 5 can be made, for example, in the form of a pipe-branch, one end of which communicates with the heat-insulating cavity 3, and its other end, during the evacuation process, is connected to the vacuum system. In order to ensure tightness of the heat-insulating cavity 3, on the termination of the evacuation process, the pipe-branch is provided with a valve.

The disadvantage inherent in such vacuum valves is their considerable weight and dimensions, which increase the weight and size of the cryostat.

It is recommendable to use a vacuum valve (FIG. 2) comprising a housing 8 connected hermetically to the vacuum-tight coat 2 and the cup 6. The cavity of the housing 8 (FIG. 2) contains a plug 9 (FIG. 2), that can be moved along its axis, and provided with a sealing ring 10 (FIG. 2) installed to the slots on its outer surfaces.

The valve 5 is provided with a cap 11 (FIG. 2) intended to protect the cavity of the valve 5 from mechanical damage. Moreover, the cryostat has an adsorption pump 12 (FIG. 1) serving to maintain the required vacuum in the heat insulating cavity 3 of the cryostat during storage of cryogenic products in it.

In order to store biological materials in the cryostat vessel 1, special containers are provided that are installed in the thermally insulated vessel and contain cups holding ampoules with biological objects.

The cryostat proposed in this invention is used as follows.

Before loading the cryostat with cryogenic products, for example, with liquid nitrogen, the vacuum is measured in the heatinsulating cavity 3. This is necessary because after a lengthy operation of the cryostat during previous use, vacuum in the heat insulating cavity can be incomplete due to the ingress of gases through the vacuum-tight coat 2 (no ideal vacuum-tight coats are known so far), through the thermally insulated vessel 1 and due to evolution of gases from the heat-insulating materials 4 in the cavity 3. The term, during which cryogenic products can be kept in the cryostat, is considerably shortened due to considerable heat ingress into the cavity 3 through the heat-insulating material, which loses its efficiency under insufficient vacuum.

Figure 2:
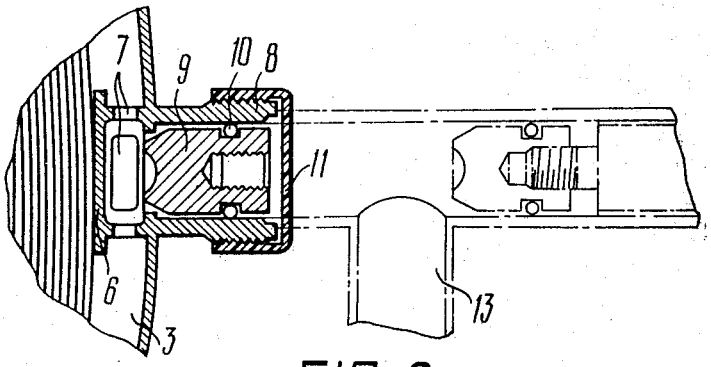
FIG. 2 is a fragmenting sectional side elevation view of a vacuum valve of the cryostat shown in FIG. 1.

To measure vacuum in the heat-insulating cavity 3, cap 11 is removed from the vacuum valve 5, and a special vacuum-meter (not shown in the Fig) and the vacuum system are connected to the housing 8 of the vacuum valve 5 through a special device (FIG. 2). With the aid of this device, plug 9 with the sealing ring 10 are withdrawn from the housing 8 and vacuum is then measured. If the vacuum is below the required value, the vacuum system 13 is actuated and the required vacuum is ensured in the heat-insulating cavity 3 of the cryostat under which the vacuum-multilayer insulation is effective. This vacuum is as a rule $1\times10^{-4}$ mm Hg, and over. The intensity of the evacuation process depends on the capacity of the evacuation system 13.

This is ensured by that between the inlet opening of the vacuum valve 5 and the outer surface of the thermally insulated vessel 1, the cup 6 is rigidly fixed, which communicates with the vacuum valve 5 and reaches with its bottom the outer surface of the vessel 1. The cup bottom has the configuration following that of the outer surface of the thermally insulated vessel. The lateral surface of the cup 6 has perforations, the total area of which is not less than the area of the pass-through section of the valve 5.

The cup 6 ensures, in the zone of the inlet opening of the vacuum valve 5, a constant vacuum gap between the outer surface of the vessel 1 and the inner surface of the coat 2. Owing to this, the perforations 7 on the lateral surface of the cup are never closed by layers of heat-insulating material 4 i.e., the pass-through section of the vacuum valve 5 is never diminished.

Moreover, the air flow in the zone of the inlet opening of the valve is always parallel to the walls (surfaces of the vessel 1 and the coat 2) of the heat-insulating cavity, which ensures intactness of the heat-insulating material 4 in the cavity 3, both during the intensive evacuation process, and at abrupt ingress of air from the environment.

On the termination of the evacuation process, by using the special device, the tube 9 is introduced into the cavity of the housing 8 of the vacuum valve 5.

The cap 11 is installed on the housing 8 of the vacuum valve 5. If the special device is not used during evacuation of the heat-insulating cavity 3, and the evacuation system is directly connected to the vacuum valve 5, the pressure in the cavity 3 will abruptly rise owing to the admission of air from the environment. In this case, owing to the presence of said cup 6, the vacuum-multilayer insulation will not be destroyed, and hence its efficiency will be preserved, since the main gas flow will strike against the bottom of the cup 6 and only when reflected from the bottom it will pass through the lateral perforations into the cavity 3. The velocity of gas will be thus markedly reduced and the heat insulation will not be destroyed.

As soon as the required vacuum is attached in the heat-insulating cavity 3, cryogenic product is poured into the thermally insulated vessel 1 through its neck and is stored in it for the required period of time. Vacuum in the heat-insulating cavity 3 is maintained during this period by the adsorption pump 12.

What we claim is:

1. A cryostat comprising, a heat-insulated vessel, heat insulation closing the vessel, a vacuum-tight jacket enclosing said vessel spaced outwardly from said insulation and defining a vacuum space therebetween under vacuum in use, a vacuum valve mounted on said jacket for taking a vacuum on said vacuum space, a cup-shaped guard to preclude insulation from clogging said valve, said guard having a bottom spaced inwardly of said jacket disposed between the insulation and the jacket and having a mouth adjacent the interior of said jacket with which said valve communicates, and said cup-shaped guard having sidewalls having through openings therein spaced from said bottom for providing communication between the interior of said cup-shaped guard and said vacuum space.

2. A cryostat according to claim 1, in which said through openings have a total area equal at least to the cross section area of the opening of said vacuum valve.

3. A cryostat according to claim 1, in which said bottom seats on said insulation.

4. A cryostat according to claim 3, in which said bottom has a configuration conforming to a surface of said insulation on which it seats.

5. A cryostat according to claim 4 in which said insulation comprises vacuum-multilayer insulation.

* * * * *